United States Patent [19]

Blumberg

[11] 4,143,645

[45] Mar. 13, 1979

[54] SELF-CONTAINED EXHAUST HOOD WITH HEAT EXCHANGER AND METHOD OF EXHAUSTING AIR

[76] Inventor: Sidney Blumberg, 3440 W. Hollywood, Chicago, Ill. 60659

[21] Appl. No.: 837,940

[22] Filed: Sep. 29, 1977

Related U.S. Application Data

[63] Continuation of Ser. No. 707,430, Jul. 21, 1976, abandoned, which is a continuation-in-part of Ser. No. 578,619, Jul. 25, 1975, abandoned.

[51] Int. Cl.[2] ..... F24C 15/20

[52] U.S. Cl. ..... 126/299 D; 55/DIG. 36; 165/DIG. 12

[58] Field of Search ..... 126/299 D; 55/DIG. 36; 165/DIG. 12

[56] References Cited

U.S. PATENT DOCUMENTS

| | | | |
|---|---|---|---|
| 3,194,308 | 7/1965 | Haried | 165/DIG. 12 |
| 3,400,649 | 9/1968 | Jensen | 126/299 D |
| 3,457,850 | 7/1969 | Sweet et al. | 126/299 D |
| 3,513,766 | 5/1970 | Ahlrich | 126/299 D |
| 3,664,255 | 5/1972 | Kuechler | 126/299 D |
| 3,805,685 | 4/1974 | Carns | 126/299 D |
| 3,827,343 | 8/1974 | Darm | 126/299 D |
| 3,870,494 | 3/1975 | Doane | 126/299 D |
| 3,978,777 | 9/1976 | Nett | 126/299 D |

*Primary Examiner*—Ronald C. Capossela
*Attorney, Agent, or Firm*—Keil & Witherspoon

[57] ABSTRACT

The invention comprises a method and an exhaust hood for the removal of heated, fouled air from a defined work area in a room having air tempering equipment, and having a source of fouled air located in the defined work area. The hood comprises an enclosure having a lower opening, the enclosure being positioned above the source of heated, fouled air, and means for supplying make-up air to the hood at a first determined rate. The make-up air is directed downwardly toward the fouled air source at a predetermined angle, thereby causing the make-up air to mix with the convectively rising heated, fouled air. The mixture of make-up air and fouled air is then exhausted at a second predetermined rate, thereby establishing an air stream from the make-up air source to the exhaust area. Contaminants are removed from the air to be exhausted and the make-up air is pre-heated with heat from the exhaust air.

1 Claim, 13 Drawing Figures

FIG. 1
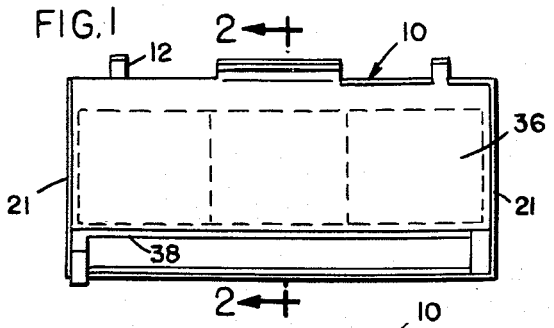
FIG. 2
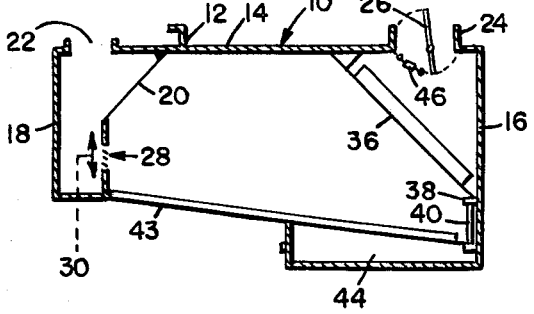
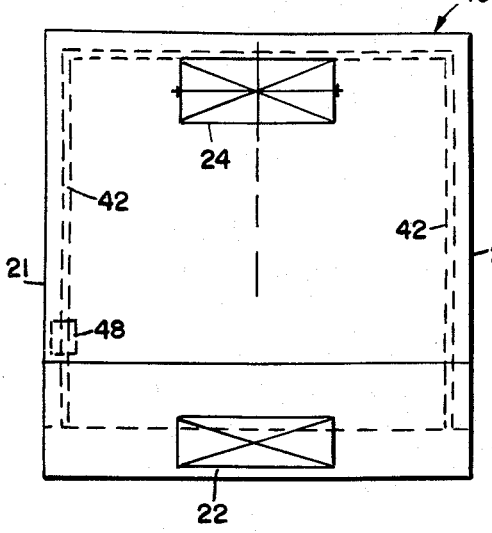
FIG. 3
FIG. 4
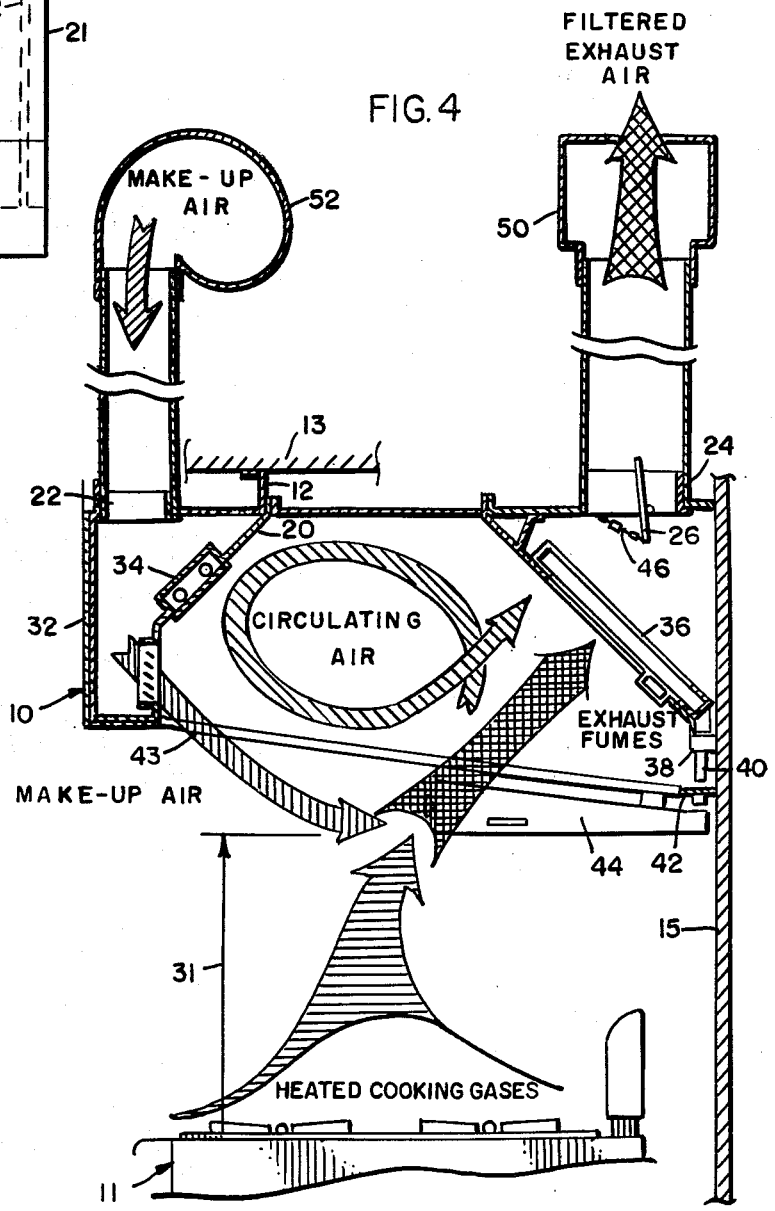

SELF-CONTAINED EXHAUST HOOD WITH HEAT EXCHANGER AND METHOD OF EXHAUSTING AIR

CROSS REFERENCE TO ANOTHER APPLICATION

This is a continuation of application Ser. No. 707,430, filed July 21, 1976, now abandoned, which is C-I-P of Ser. No. 578,619 filed July 25, 1975, now abandoned.

BACKGROUND OF THE INVENTION

1. Field of the Invention

The present invention relates to an improved, self-contained exhaust hood for placement above a cooking surface in order to effect the removal of smoke, cooking odors and the like while supplying fresh air to the work area. The unit is designed to achieve optimum removal of fouled air, while requiring only a minimum of make-up air from the tempered room air, thus reducing overall energy consumption.

2. The Prior Art

Many self-contained cooking exhaust systems are known in the art, all having in common the feature of a make-up air duct located within the exhaust hood for supplying make-up air from a source other than the temperature-controlled (tempered) room air. However, all of the arrangements proposed until now have had a number of disadvantages which make their use less than ideal.

For example, U.S. Pat. No. 3,457,850 describes an "air curtain" ventilating hood which is operable in one of two modes. In a first mode, when the outside, or make-up air is at a relatively low temperature a single curtain of make-up air from the outside is passed through the hood from a register at the interior of the lower front hood wall to an exhaust area at the upper rear hood wall. Since the make-up air is not directed beyond the lower lip of the hood the apparatus must rely exclusively upon convective forces to raise the heated, fouled cooking air into the relatively cooler make-up air curtain for entrainment and exhaust. The ventilator hood must not be raised very high above the cooking area or the scavenging function of the make-up air curtain is lost.

The ventilator hood of U.S. Pat. No. 3,457,850 may be operated in a second mode when the make-up air temperature is relatively high. In this second mode, a secondary air curtain is projected outwardly from the front hood wall into the room, the secondary air curtain passing just beneath the lower lip of the front hood wall into the make-up air curtain described above. This second mode of operation results in still further disadvantages. First, a discomfiting draft past the cook's head is realized from the secondary air curtain. Secondly, no significant additional entrainment of the fouled cooking air obtains and, in fact, the first-mentioned make-up air curtain is reduced by the amount of air supplied to the secondary air curtain. Finally, the projection of make-up air to the kitchen results in added heat loading of the restaurant air-conditioning system, which increases the cost of operation markedly.

Another exhaust hood arrangement is taught in U.S. Pat. No. 3,890,887 which comprises a modification of the hood described above with respect to U.S. Pat. No. 3,457,850. In the '887 design a "ventilation door" is installed in the lower front hood wall for downwardly directing a flow of make-up air on or behind the cook in order to maintain temperature control at work stations adjacent to the cooking area located beneath the exhaust hood. Louvers are provided in the register at the lower front hood wall for directing the primary make-up air curtain from this register inwardly of the hood toward the exhaust area at the upper rear hood wall. The modified exhaust hood of U.S. Pat. No. 3,890,887 serves well to cool the kitchen in work areas apart from the cooking area, but suffers the disadvantage of reducing the effectiveness of the exhaust-bound air curtain by the amount of make-up air used to temper the kitchen environment, as well as having the drawbacks of the U.S. Pat. No. 3,457,850 vent hood.

A further exhaust hood for fouled cooking air is taught in U.S. Pat. No. 3,664,255. This device utilizes the make-air flow from lower front to upper rear walls of the hood. However, it relies heavily on convective forces to raise the fouled cooking air into the make-up air stream and does not provide adequate means for lifting the fouled air into entrainment with the hood-contained make-up air stream. Although a supplemental air stream is directed inwardly from the front hood wall lower edge, it does not extend downwardly out of the hood and does not serve to lift the main body of fouled air toward the exhaust vent.

SUMMARY OF THE INVENTION

It is accordingly an object of the present invention to provide a ventilation hood for exhaust of fouled cooking air from a kitchen work space. It is a further object to provide such a ventilation hood which directs such make-up air for lifting and entraining fouled air from a cooking area, and exhausting this fouled air from the kitchen.

It is yet another object of the invention to provide an exhaust hood which will reduce the amount of tempered room air exhausted with the fouled cooking air, thereby effecting an energy savings by reducing the amount of air tempering required for the kitchen area.

The invention comprises method and apparatus for injecting make-up air into the airflow of an exhaust hood such that the make-up air stream entrains and lifts fouled cooking air into the exhaust outlet of the hood. Make-up air from outside is injected into a plenum at the forward area of the hood, and is then directed downwardly at a predetermined angle into the area beneath the hood and above the cooking equipment. An exhaust outlet at the rear wall of the hood then removes the fouled cooking air. The downward angle at which the make-up air stream is directed is chosen so that the superheated, fouled air from the cooking equipment becomes entrained as it rises by convection into the make-up air stream, thereafter being carried upwardly to the exhaust outlet. In this regard, louvers provided in the make-up air plenum are adjustable so as to position the make-up air stream at its most efficient angle. Circulation of air heated by the cooking device takes place in the upper area of the hood, and this circulating air contacts one or more surfaces of the make-up air plenum so as to preheat the make-up air. Surfaces of the make-air plenum not in contact with this circulating heated air are insulated so as to reduce loading on the kitchen's air tempering equipment.

In one embodiment of the invention, a heat exchanger is provided for removing heat from the exhaust air and transferring it to the make-up air so as to further preheat the make-up air.

The exhaust hood of the present invention is most efficient at capturing grease-and smoke-laden cooking air from the kitchen work area, while avoiding drafts over the cooks and other kitchen personnel and avoiding the exhaust of large amounts of tempered kitchen air. Although some make-up air must be taken from the kitchen area in order to maintain a negative pressure and prevent smoke and odors from drifting into the general kitchen or the dining area, the exhaust hood of the present invention allows the amount of make-up air taken from the kitchen area to be reduced to between 20 and 25% of the total exhaust air. Further objects and advantages of the present invention will become apparent to those skilled in the art in view of the following drawings and accompanying detailed description of the invention.

BRIEF DESCRIPTION OF THE DRAWINGS

FIG. 1 shows a partial front view of a first embodiment of the exhaust hood of the present invention;

FIG. 2 is a section view taken along line 2—2 of FIG. 1;

FIG. 3 is a plan view of the exhaust hood of FIG. 1;

FIG. 4 is a more detailed section view of the exhaust hood of FIG. 1, and showing the flow of air through the hood;

Figure 5:
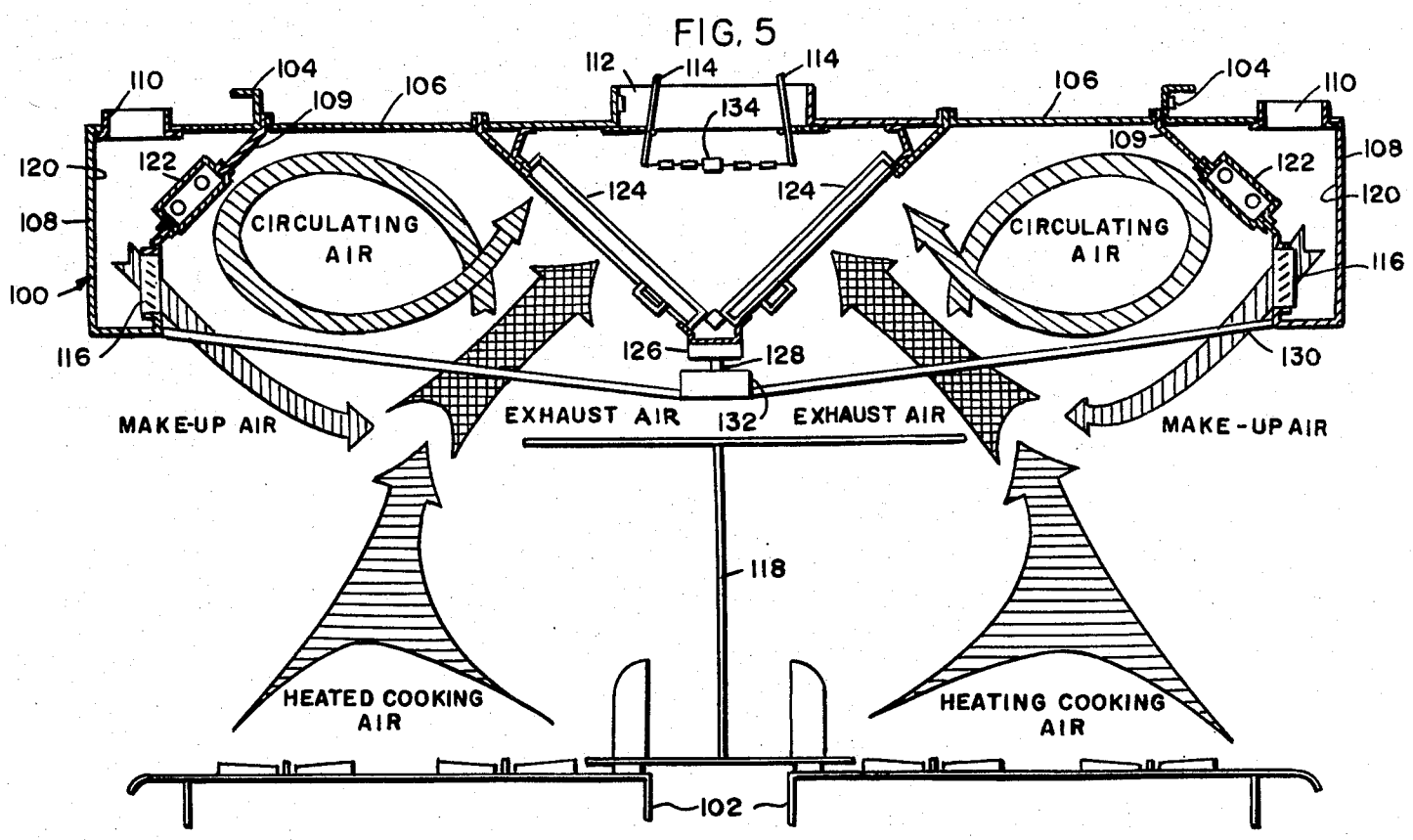
FIG. 5 shows a partial cross-sectional view of a second embodiment according to the present invention, and showing the flow of air through the exhaust hood.

DETAILED DESCRIPTION OF THE PREFERRED EMBODIMENTS.

A first embodiment of the exhaust hood of the present invention will now be described with reference to FIGS. 1-4. The hood is shown generally at 10 and, as can be seen in FIG. 4, is mounted in a conventional manner to a ceiling by hanger brackets 12 and/or to a wall. Although the hood shown is both ceiling and wall mounted, it will be understood by those skilled in the art that the hood may be modified so as to be only ceiling or wall mounted or so as to be free-standing, without departing from the spirit and scope of the invention. The hood, as is conventional, is positioned directly above a cooking appliance 11.

The hood comprises a top panel 14, a rear panel 16, exterior front panel 18, interior front panel 20 and end walls 21. These panels may be fabricated from any suitable sheet metal such as stainless steel and the joints may be welded or otherwise suitably fastened. A make-up air opening collar 22 and an exhaust air opening collar 24 are provided in the top panel 14 and are fabricated in the same manner as the exhaust hood panels. The exhaust collar is mounted with a conventional fire control damper 26 which is to be closed upon the exhaust collar or exhaust air temperature reaching a predetermined level. Although an electromechanical control may be supplied for closing the damper 26, the damper shown is simply counter-weighted to rotate to a closed position upon melting of fusible link 46. Exterior front panel 18 and interior front panel 20 are spaced apart as shown to form, with end panels 21, a plenum into which make-up air is supplied through collar 22.

Make-up air is discharged from the plenum through make-up air louvers 26, the louvers being controllable by a louver control apparatus shown schematically at 30. The louver control apparatus 30 may comprise, for example, a rigid bar pivotally connected to each slat of the louver assembly, the slats being in turn mounted for rotation about their respective longitudinal axes. The precise arrangement of the louver control apparatus is not critical, so long as the louvers are adjustable for directing the flow of make-up air at the desired downward angle, as will be discussed in greater detail below. Interior panel 20 may be fitted with a vapor-proof light fixture or with a fluorescent fixture 34 connected to a power supply through terminal box 48. Exterior panel 18 may be thermally insulated with a suitable material 32 such as fiberglass batting.

Grease-laden air to be exhausted is passed through a grease extractor 36, and the grease trapped thereby drains down pitched grease trough 38 to drain tube 40. A drain gutter 42 is also provided for catching grease emanating from drain tube 40 as well as grease which collects and runs down the exhaust hood panels. Hemmed edges 43 of the end panels serve to direct grease collected on the end panels down to gutter 42, and an opening in gutter 42 funnels the collected grease into a removable grease container 44. An exhaust air blower is provided in the duct connected to exhaust collar 24, while a make-up air blower is provided in the duct connected to collar 22. Each duct is mounted in a conventional manner and passes through the ceiling, roof, and other structural members of the building.

Referring now to FIG. 4, the flow of air through the exhaust hood can be seen. Make-up air is supplied from the outside by blower 52 and the air is directed downwardly by louvers 28 to a point well below the lower lip of the hood side panels. At the same time, heated cooking gases which rise convectively from the cooking appliance meet with the make-up air at a distance 31 above the surface of the cooking appliance, this distance 31 being significantly less than the distance from the cooking appliance to the lower hood edges. The cooking gases are entrained in the air flow and are lifted, mixed with the make-up air, through the grease extractor 36 and into the exhaust duct by blower 50. The make-up air supplied through louvers 28 comprises about 75-80% of the total exhaust air, thereby reducing the amount of tempered room air which is exhausted to a level of about 20-25%. This substantially reduces the loading on the room air tempering equipment.

Further reducing such loading is the transfer of heat from the cooking gases to the make-up air by having a circulating air stream as shown in FIG. 4. The circulating air stream is heated by the cooking gases and transmits such heat to the make-up air through interior front panel 20 which acts as a heat exchanger.

Referring now to FIG. 5, it can be seen that the principles of the exhaust hood of FIGS. 1–4 may be applied equally well to a double exhaust hood for use over multiple cooking appliances. The dual exhaust hood 100 is mounted above cooking appliances 102, for example by hanger brackets 104. The exhaust hood has a top panel 106, exterior front panels 108 and interior front panels 109. A make-up air opening collar 110 is provided in the top panel 106 near each exterior front panel, while a single exhaust air opening collar 112 is provided in a central location on the top panel 106. In the embodiment shown, dual fire control dampers 114 are provided in the exhaust air opening collar and are counter weighted so as to close automatically when fusible link 134 is melted.

The interior and exterior front walls 108 and 109 form a pair of make-up air plenums which have adjustable make-up louvers 116 for directing the make-up air downwardly with respect to the exhaust hood. The means for adjusting the make-up air louvers is not shown in FIG. 5.

The exterior front panels 108 of the make-up air plenums are provided with insulation 120 so as to reduce the effect of heat transfer between the make-up air and the tempered room air. Light fixtures 122 may be provided in the interior front panels as shown. The exhaust hood of FIG. 5 is arranged in much the same manner as that of FIGS. 1–4 to collect grease, with grease extractors 124, pitched grease trough 126, drain tube 128, hemmed end wall edges 130 and a grease container 132.

The hood is positioned and the make-up air louvers are directed such that the make-up air will travel downwardly below the lower edges of the exhaust hood side panels and entrain the convectively rising heated cooking gases as shown. As in FIG. 4, the circulating air inside the hood serves to preheat the make-up air by heat exchange through panels 109. By proper adjustment of the exhaust and make-up air blowers (not shown), the tempered room air which is exhausted can be kept at or below 25% without affecting the ability of the exhaust hood to properly remove contaminated air from the kitchen area.

Figure 6:
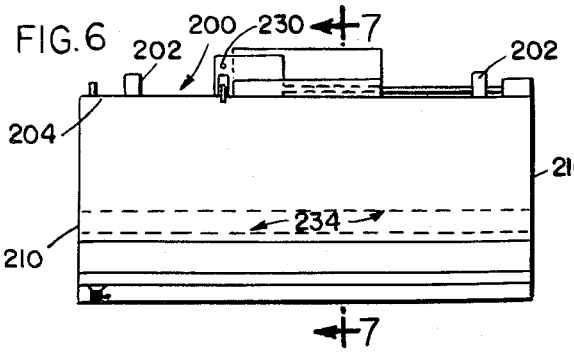
FIG. 6 shows a partial front view of a third embodiment of the exhaust hood of the present invention.
Figure 7:
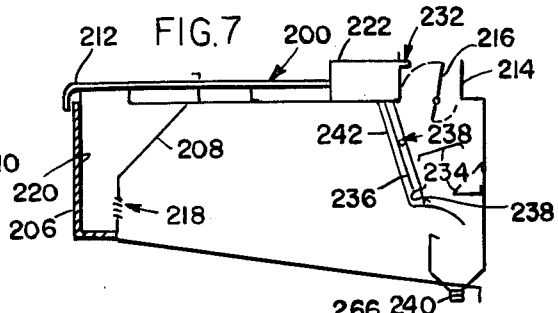
FIG. 7 shows a section view taken along line 7—7 of FIG. 6.
Figure 8:
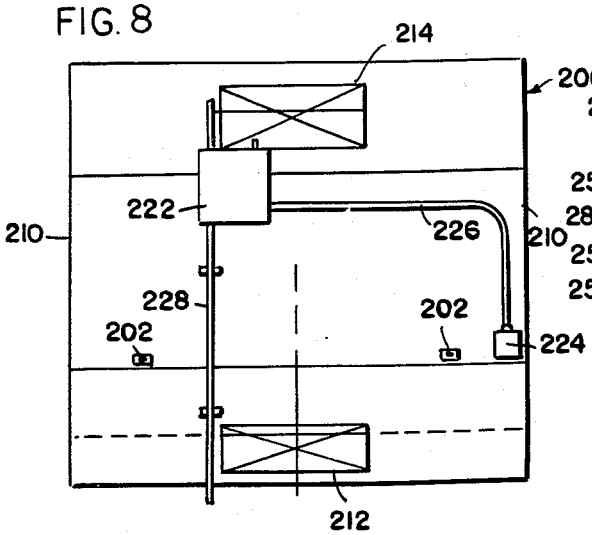
FIG. 8 shows a plan view of the exhaust hood of FIG. 6.

Referring now to FIGS. 6–10, a third embodiment of the present invention is shown. FIGS. 6–8 show exhaust hood 200 which is mounted by, for example, hanger brackets 202 and having a top panel 204, an exterior front panel 206, an interior front panel 208 and end panels 210. A make-up air opening collar 212 and an exhaust air opening collar 214 are provided in the top panel. The exhaust air opening collar has a fire control damper 216 and the interior front panel has make-up air louvers 218 with an adjusting mechanism (not shown). Insulation 220 is included for exterior front panel 206 to reduce the amount of heat exchanger between the make-up air and the tempered room air.

At 222 is shown a damper control box which electromechanically shuts the fire control damper when the exhaust air temperature becomes too great. In FIG. 8 can be seen the terminal box 224 for the electrical wiring and the conduit 226 which directs the electrical wiring to the damper control box. A manual damper reset rod 228 is supplied, as is a fire damper indicator light 230 which warns when the damper is closed. Heat sensor 232 is connected to the fire damper control circuitry, as will be discussed below, for triggering the damper control.

The exhaust hood of FIGS. 6–8 is very similar to that of FIGS. 1–4, except that means is provided for trapping and washing away the grease which is carried by the exhaust air. Baffles 234 are installed in the exhaust air plenum as shown and water spray pipes 236 with spray heads 238 serve to scrub the baffles at predetermined intervals. A drain outlet 240 allows the waste to be directed out of the exhaust hood, while removable panel 243 permits inspection and repair of the scrubbing mechanism.

It will be understood that air flow through the hood shown in FIGS. 6–8 is substantially the same as that of the hood of FIGS. 1–4. In particular, the make-up air is directed downwardly by louvers 218 so as to provide an air current below the lower lip of the exhaust hood side panels which will entrain and carry toward the exhaust plenum the grease-laden, fouled cooking air.

Figure 9:
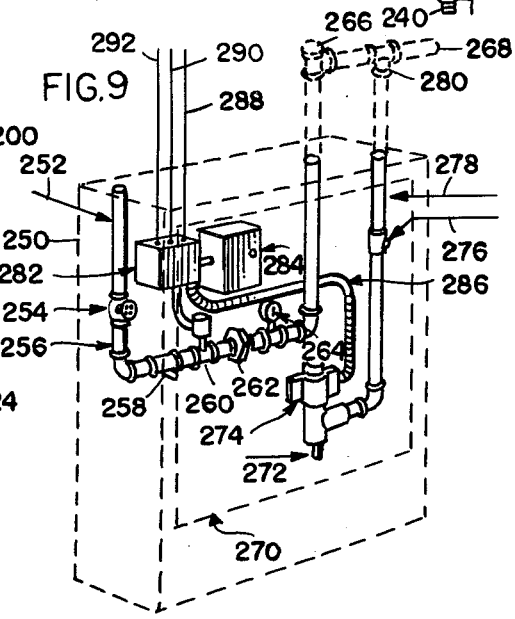
FIG. 9 shows in schematic form a control panel for the wash system of the exhaust hood of FIG. 6.

The controls and scrubbing mechanism of the exhaust hood of FIGS. 6–8 will now be described with reference to FIGS. 9 and 10. FIG. 9 shows in phantom a control panel enclosure 250 which surrounds the washing mechanism circuitry. A hot water supply pipe 252 connected to a hot water heater (not shown) goes to a hand valve 254, connected by pipe 256 to line strainer 258, which removes sediment and other debris from the water. A solenoid valve 260 connects to a union 262, which in turn connects to a pressure gauge 264. From the pressure gauge, the water line travels through a vacuum breaker 266 and on to water spray lines 236 in the exhaust hood through pipe 268.

At 270 is shown schematically a detergent tank which may be located within control panel enclosure 250. A detergent pump 274 is positioned adjacent the detergent tank and has a detergent inlet tube 272 and an outlet which connects to a check valve 276, through tubing 278 to a Tee 280, where the detergent line joins the water line. It will be understood by those skilled in the art that the detergent pump may be controlled to provide a predetermined mixture of detergent and water to the exhaust hood sprayers.

Also located within the control panel enclosure 250 are a relay box 282 and a timer 284. The relay box contains switches which actuate various components of the washing system in proper sequence when triggered by the preset timer. Sealed conduit 286 carries wiring from the relay box to the pump and from the relay box to the solenoid valve. Wires 288 and 290 extend from the relay box to the fire damper and sensor, and to the push button switches of the exhaust and make-up blowers, respectively, while wire 292 extends to a power supply, such as a 120 volt alternating current source.

Figure 10:
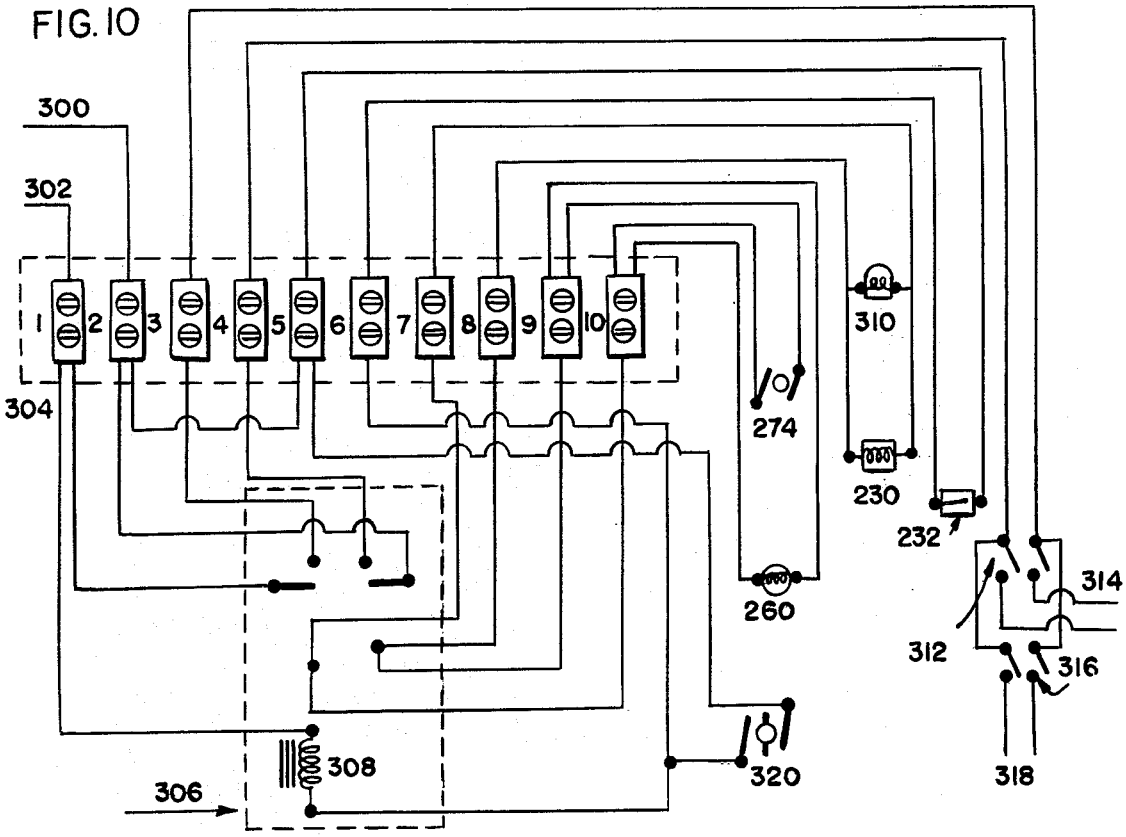
FIG. 10 shows in schematic form a wiring diagram of the exhaust hood of FIG. 6.

FIG. 10 shows a schematic wiring diagram of the washing circuitry for the exhaust hood of FIGS. 6–8. Terminal block 304 has supplied to it a hot wire 300 and a ground wire 302 from an alternating current supply. A double pole double throw (DPDT) relay having a relay coil 308 is connected as shown for controlling the various functions of the exhaust hood. As noted above, a heat sensor 232 is connected for triggering fire damper solenoid 310 so that the fire damper will be closed automatically when a predetermined exhaust temperature is reached. Fire damper indicator light 230 is connected in parallel with the fire damper solenoid so as to indicate when the damper is closed.

The hot water supply solenoid valve 260 and detergent pump 274 are connected to power cables 300 and 302 through the contacts of relay 306 when timer switch contacts 320 close, providing power to activate relay coil 308. It will be noted that power to the make-up and exhaust blowers is cut off by the circuit when the wash cycle is initiated. Double pole start switch 312 connects the power lines to the exhaust blower motor coil through wires 314, while double pole start switch 316 supplies power to the make-up blower motor coil through wires 318.

Figure 11:
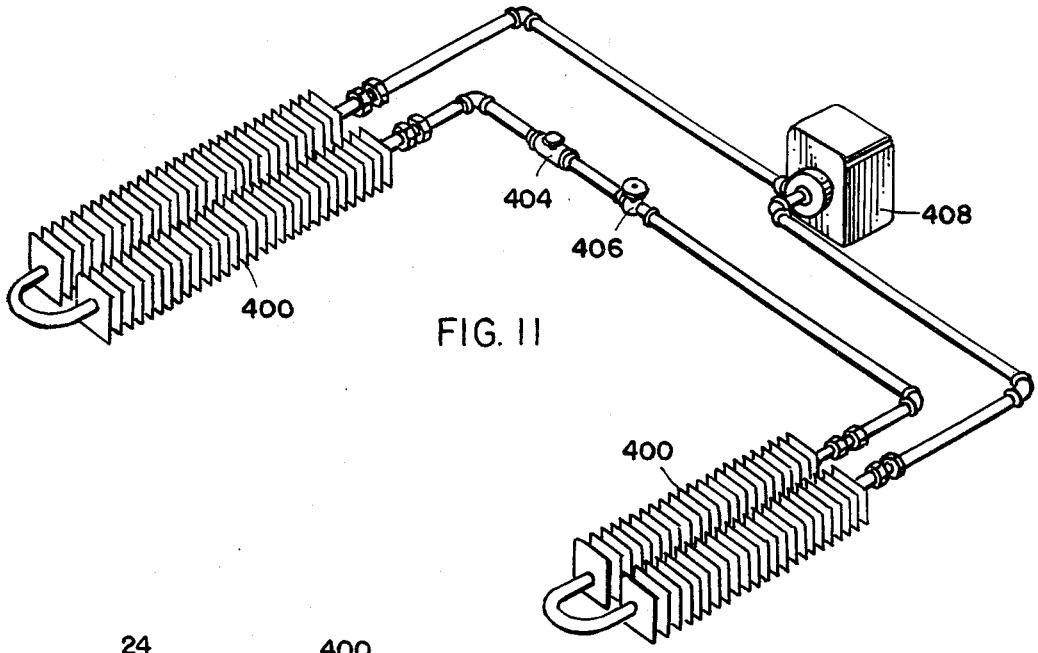
FIG. 11 shows in isometric view of a heat exchanger to be used in the exhaust hood for transferring heat from exhaust air to the make-up air.
Figure 12:
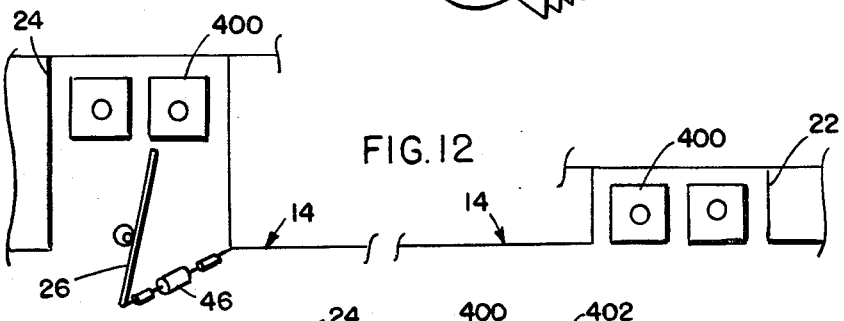
FIG. 12 is a partial cross-sectional view showing the installation of the heat exchanger fin coils in the make-up and exhaust collars of the exhaust hood.
Figure 13:
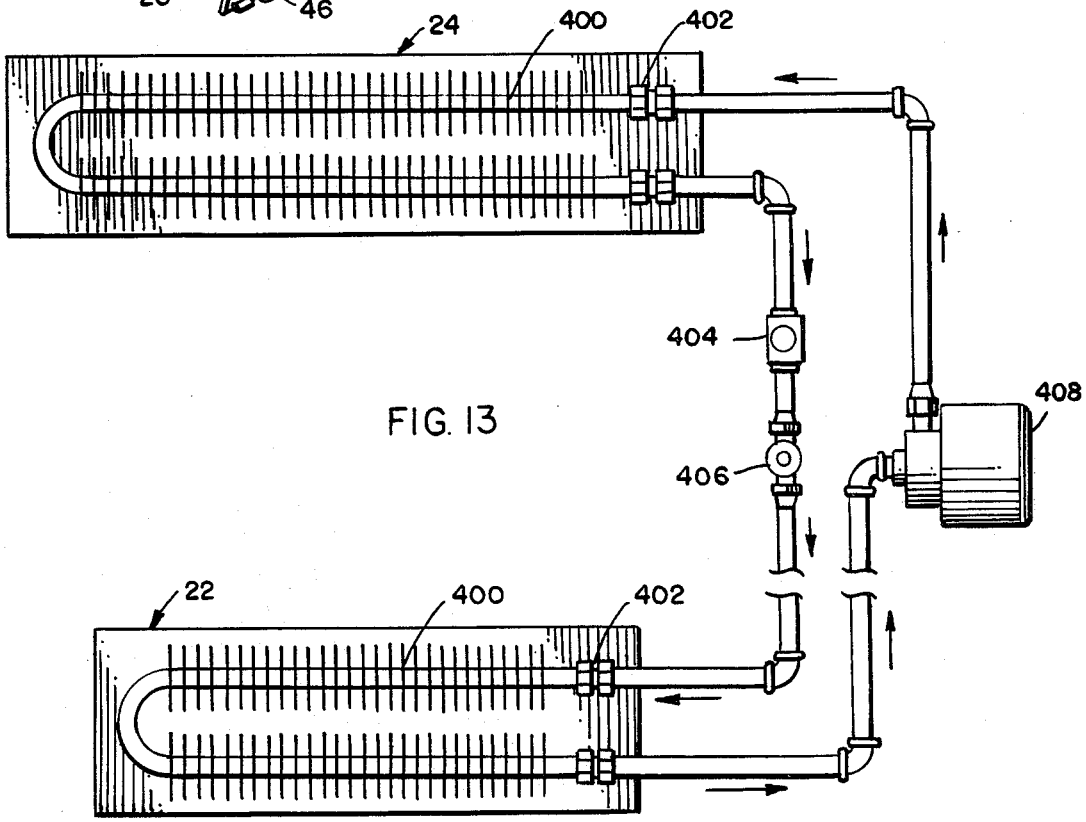
FIG. 13 shows a plan view of the heat exchanger system.

As noted above, the circulating air in the exhaust hood transfers heat from the cooking gases to the make-up air by heat exchange through the interior front panel of the exhaust hood. However, when the outside, or make-up, air is of sufficiently low temperature, the pre-heating of the make-up air in this fashion may be inadequate to assure that the grease in the cooking air reaches the grease extractor or baffle system prior to congealing. For this reason, a supplemental heat exchanger may be provided as shown in FIGS. 11–13. The supplemental heat exchanger is shown in isometric view in FIG. 11, and comprises a pair of double row fin coils which are connected by suitable tubing to a liquid pump 408. The tubing which interconnects the pair of double row fin coils has, in series, compression unions 402, a fill and purge fitting 404, and a sight glass fitting 406. A suitable liquid, such as water, is circulated through the tubing for transferring heat from the exhaust duct coil to the make-up duct coil.

As shown in FIG. 12, the double row fin coils can be mounted in the make-up and exhaust air opening collars 22 and 24, respectively. The collars, as noted above with respect to FIGS. 1–4 are mounted in the top panel 14 of the exhaust hood, with the double row fin coils in the exhaust collar being mounted downstream from the fire control damper 26. A suitable electronic control (not shown) can be provided for sensing the relative difference between the exhaust and make-up air temperatures so as to close the circuit between the fluid pump motor and a power supply. In this fashion, the heat of the exhaust air may be transferred to the make-up air, thereby further reducing the loading upon the room air tempering system and preventing the air stream which extends below the lower lip of the exhaust hood from becoming so low in temperature that it causes the grease from the heated cooking gases to congeal too early or from reducing the temperature above the cooking appliance enough to effect the cooking temperatures.

It will be understood that the make-up air louvers may be adjusted so as to direct the make-up air stream to the proper angle for adequately entraining and removing fouled cooking air without causing cool drafts upon the kitchen employees, or affecting the flame settings or cooking times of the cooking appliance. The manner in which such adjustment may be effected will be obvious to those skilled in the art.

Although the foregoing detailed description of the invention relates to the preferred embodiments thereof, it will be understood by those skilled in the art that numerous changes may be made without departing from the spirit and scope of the invention.

I claim:

1. An exhaust system for the removal of heated, fouled air from a defined work area in a room having air tempering equipment, and having a source of said fouled air located in said defined work area, comprising:

a hood structure defining a central, downwardly open space, and first and second chambers adjacent said central space forwardly and rearwardly thereof, respectively;

means for supplying make-up air to said hood structure at a first predetermined rate;

said first chamber being in communication with said make-up air supply means, and having a heat-insulated front wall and a heat-conducting rear wall;

means for exhausting the mixture of make-up air and fouled air from said hood structure at a second predetermined rate;

said second chamber being in communication with said exhausting means and having an upwardly and forwardly slanted front wall, and also being in communication with said central space through an aperture in the last-mentioned front wall; and means in said second chamber for removing contaminants from said mixture of make-up air and fouled air;

there being provided in the lower portion of the rear wall of said first chamber a diagonally downwardly and rearwardly inclined air flow directing means for projecting all of said make-up air through a portion of said central space toward said fouled air source, the angle of inclination of said directing means being such that said make-up air mixes with the rising heated, fouled air in a zone located below said bottom plane but at a substantial distance above said fouled air source and that the mixture, upon re-entering said central space, in part passes through said removing means to said exhausting means and, to another part, circulates along the upwardly and forwardly slanted front wall of said second chamber towards and along said heat-conducting rear wall of said first chamber so as to pre-heat the make-up air passing through said first chamber.

* * * * *